United States Patent [19]

Tateishi

[11] Patent Number: 4,892,985

[45] Date of Patent: Jan. 9, 1990

[54] VACUUM RESPONSIVE MULTICONTACT SWITCH

[75] Inventor: Yosuke Tateishi, Anjo, Japan

[73] Assignee: Aisin Seiki Kabushiki Kaisha, Kariya City, Japan

[21] Appl. No.: 302,606

[22] Filed: Jan. 27, 1989

[30] Foreign Application Priority Data

Jan. 29, 1988 [JP] Japan ..... 63-020245

[51] Int. Cl.[4] ..... H01H 35/34

[52] U.S. Cl. ..... 200/83 N; 200/81.4; 200/835; 200/252; 73/723

[58] Field of Search ..... 200/81.4, 249, 252, 200/257, 259, 83 R, 83 J, 83 A, 83 N, 83 S, 83 SA; 340/626; 307/118; 338/42; 73/717, 723, 725

[56] References Cited

U.S. PATENT DOCUMENTS

| | | | |
|---|---|---|---|
| 3,689,719 | 9/1972 | Phillips | 200/83 S |
| 4,334,131 | 6/1982 | Cooper | 200/81.4 |
| 4,452,202 | 6/1984 | Meyer | 73/723 |
| 4,648,277 | 3/1987 | Obermann | 200/83 R |
| 4,778,956 | 10/1988 | Betterton | 338/42 |

*Primary Examiner*—Gerald P. Tolin

*Attorney, Agent, or Firm*—Oblon, Spivak, McClelland, Maier & Neustadt

[57] ABSTRACT

A multicontact vacuum responsive switch includes a housing divided into first and second chambers by a diaphragm. The first chamber is connected to a vacuum source while the second chamber communicates with atmospheric pressure, so that the diaphragm is movable within the housing in response to a pressure differential between the first and second chambers. A plate is connected to the diaphragm for movement therewith, and has an electrically conductive portion of a predetermined pattern. A plurality of electrical contacts are mounted in the housing and slidably contact the plate such that the contacts may selectively contact the electrically conductive portion of the plate in response to movement of the diaphragm means, which also cause movement of the plate. One of the contacts always contacts the conductive portion, and so is a reference contact. It can be put in electrical communication with the other contacts by the sliding movement of the other contacts into contact with the conductive portion of the plate in response to predetermined vacuum pressures in the first chamber. At least one of the contacts is adjustable in the direction of movement of the diaphragm.

6 Claims, 3 Drawing Sheets

VACUUM RESPONSIVE MULTICONTACT SWITCH

BACKGROUND OF THE INVENTION

1. Field of the Invention

This invention relates to a vacuum responsive multicontact switch and more particularly to a vacuum responsive multicontact switch for engine control systems of automobiles.

2. Statement of Related Art

A known vacuum responsive switch of this type is disclosed in the Japanese patent application published on Feb. 1, 1980 as publication number 55-14630. This switch has a pair of movable switch contacts, between which is disposed a fixed contact having a plurality of terminals.

The above conventional switch has the drawback that on-off actuation and off-on actuation of the two movable contacts are carried out at one fixed pressure level. Further, it is difficult to adjust the positions of the two movable contacts due to the structure of the adjuster.

SUMMARY OF THE INVENTION

It is, therefore, an object of the present invention to provide an improved multicontact vacuum pressure switch which can obviate the above conventional drawbacks.

It is another object of the present invention to provide an improved multicontact vacuum pressure switch which can be used in an engine with a plurality of control systems which need to be actuated at a plurality of vacuum control levels.

The above, and other, objects are achieved according to the present invention by a multicontact vacuum responsive switch which includes a housing divided into first and second chambers by a diaphragm. The first chamber is connected to a vacuum source while the second chamber communicates with atmospheric pressure, so that the diaphragm is movable within the housing in response to a pressure differential between the first and second chambers.

A plate is connected to the diaphragm for movement therewith, and has an electrically conductive portion of a predetermined pattern. A plurality of electrical contacts are mounted in the housing and slidably contact the plate such that the contacts may selectively contact the electrically conductive portion of the plate in response to movement of the diaphragm, which also causes movement of the plate. One of the contacts always contacts the conductive portion, and so comprises a reference contact. It can be put in electrical communication with the other contacts by the sliding movement of the other contacts into contact with the conductive portion of the plate in response to predetermined vacuum pressures in the first chamber. At least one of the contacts is adjustable in the direction of movement of the diaphragm.

BRIEF DESCRIPTION OF THE DRAWINGS

These and further objects of the present invention will become more clear in accordance with the following description of the preferred embodiment of present invention with the attached drawings, wherein.

DETAILED DESCRIPTION OF A PREFERRED EMBODIMENT OF THE INVENTION

Figure 1:
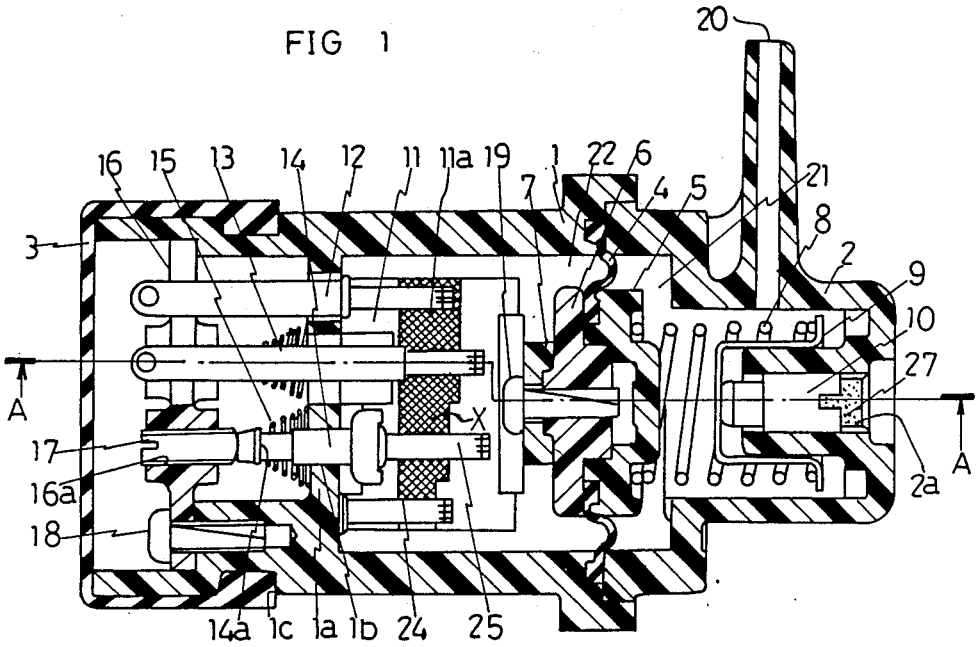
FIG. 1 is a longitudinal cross-sectional view of the vacuum responsive switch according to the present invention.

Referring now to the drawings, first body 1 and second body 2 are connected together by a suitable means such as ultrasonic welding to form an air-tight housing. Dust cover 3 is removably disposed in annular groove 1c provided on the outer periphery of the first body 1 to prevent water or the like from entering the housing. Diaphragm 4 is sealingly held between the first and second bodies 1, 2 at its outer periphery and between pressure plate 5 and retainer 6 at its inner periphery.

Vacuum chamber 21 and atmospheric pressure chamber 22 are separated by the diaphragm 4. The second body 2 includes a vacuum inlet port 20 which is connected to a vacuum source such as an intake manifold (not shown) of an engine and a threadable hole **2*a* in which an adjusting screw 10 (second screw) is threaded. One end of the screw 10 contacts with a thrust washer 9 which is axially movable in response to the adjusting operation of the screw 10. Spring 8 (second spring) is disposed in the vacuum chamber 21 and engages with the washer 9. Turning the adjusting screws 10 axially moves the thrust washer 9** to adjust the biasing force of the spring.

The first body 1 includes an atmospheric pressure inlet port 26 which is exposed to the atmospheric pressure through an air cleaner (not shown). The diaphragm 4 is axially movable by the pressure differential between the two chambers 21 and 22. The spring 8 is engaged with the pressure plate 5 to always bias the plate as well as the retainer 6 and movable guide plate 7 which is secured to the retainer 6 by screw bolt 19.

Figure 5:
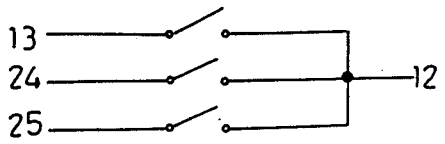
FIG. 5 is a circuit diagram for the contacts.

Switching plate 11 is provided on the guide plate 7 and includes an electric conductive portion **11*a*. Four stationary contacts 12, 13, 24 and 25 are provided on a partition wall 1*a* which has through holes 1*b*. The contact 12 is a reference contact which is fixed to the wall 1*a* and can be placed in electrical continuity with at least one of the contacts 12, 14 and 25 (FIG. 5) via the conductive portion 11*a***.

Figure 2:
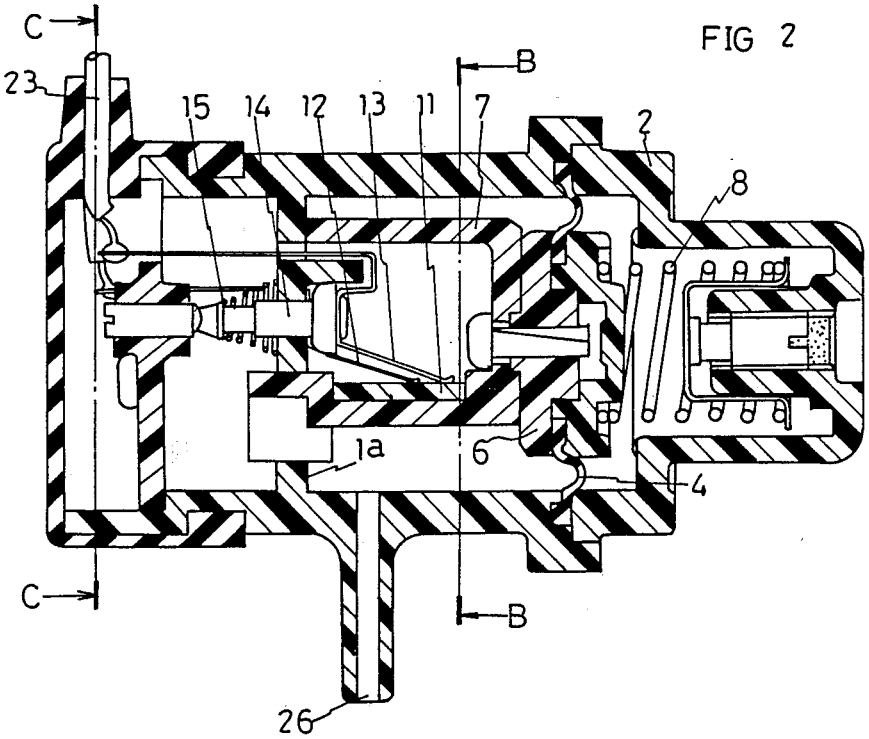
FIG. 2 is a cross-sectional view of the vacuum responsive switch taken along the line II—II in FIG. 1.
Figure 3:
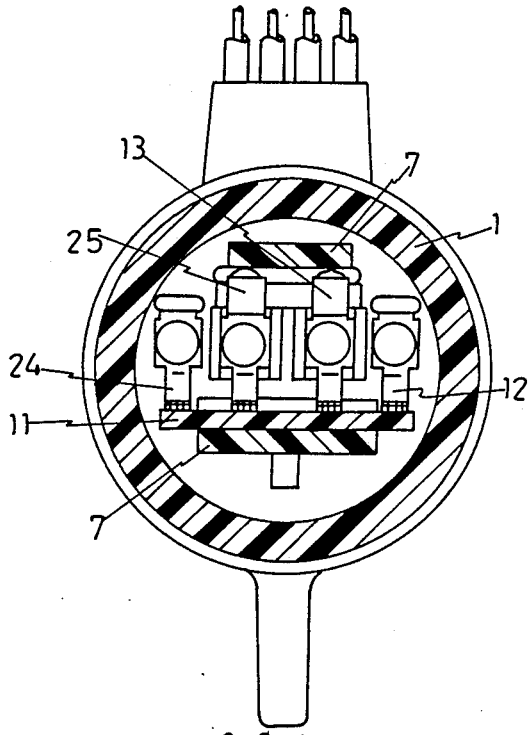
FIG. 3 is a cross-sectional view of the vacuum responsive switch taken along the line III—III in FIG. 2.
Figure 4:
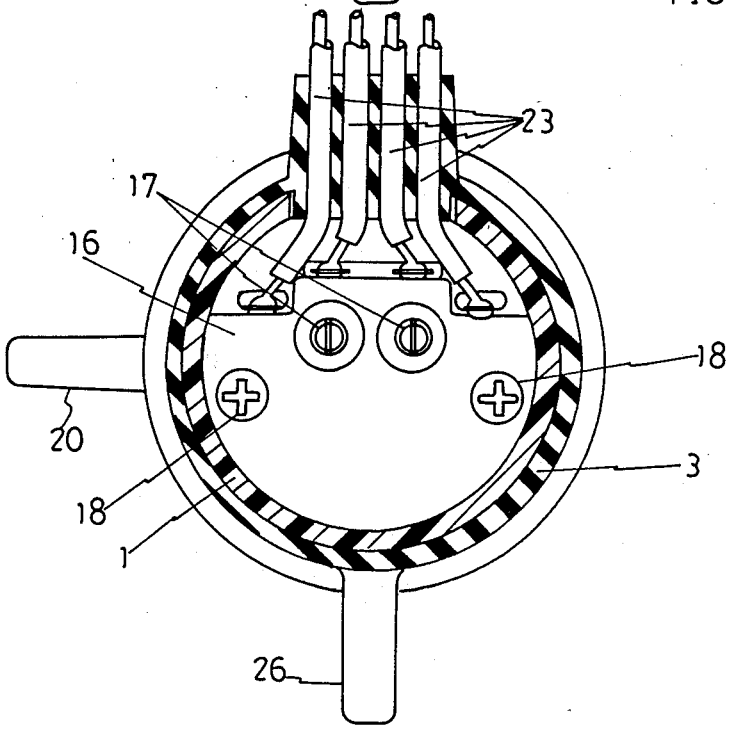
FIG. 4 is a cross-sectional view of the vacuum responsive switch taken along the line IV—IV in FIG. 2.

The conductive initiation position of the contacts 13 and 25 relative to the reference contact 12 is changable by adjusting their positions. Contacts 13 and 25 are each mounted on a stem 14 (only one is shown). Stems 14 are each slidably inserted into one of the holes **1*b* of the partition wall 1*a* and the contacts 13 and 25 are each connected to one end of the stems 14, respectively. The other end of each stem 14 is engaged with an adjusting screw 17 threadably inserted into the holes 16a of a wall 16. By rotating the screws 17 (first screw) from the outside (FIG. 4), the axial positions of the contacts 13 and 25 are adjusted. Numeral 15 indicates adjuster springs (first spring) bearing on the flanged portions 14*a* of the stems 14 for always biasing the stems in the leftward direction as viewed in FIG. 2. The screws 18 are used for connected the wall 16 to the first body 1**.

The other contact 24 is fixed to the wall 1*a*. Its position relative to the conductive portion is adjusted by the adjusting screw 10, which moves conductive portion 11*a*. Numeral 27 indicates sealing agent for sealing the housing after the adjusting operation. A conductive wire 23 connects to each of the contacts 12, 13, 24 and 25. Contact 12 may be connected to a source of current while contacts 13, 24 and 25 are each electrically connected to a respective engine control system to be actuated at a given vacuum pressure level.

A vacuum from the vacuum source is introduced into the vacuum chamber 21 via vacuum inlet port 20. Due to the pressure differential between the two chambers 21 and 22, the diaphgram 4 is moved in the right direction as viewed in FIG. 1 and guide plate 7 and switching plate 11 are also moved in the right dirction to create a sliding contact between the contacts 24, 13 and 25 with the conductive portion 11*a*.

Figure 6:
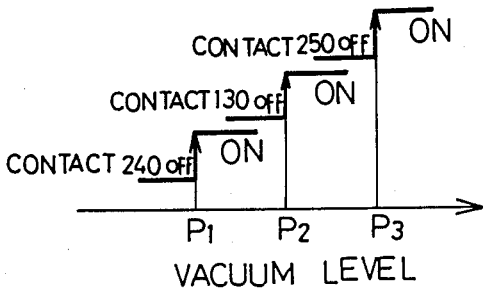
FIG. 6 is a graph illustrating the operation of the invention.

Pattern X is provided on the conductive portion 11*a* in such a way as to permit independent selection of the on-off operations of the contacts 24, 13 and 25. For example, as is shown in FIG. 6, when the vacuum level reaches P1, contact 24 is on (i.e. is in electrical continuity with contact 12), the other two being off. When the vacuum level incrases to P2, contact 13 becomes on, keeping the contact 25 off and contact 24 on. When the vacuum level becomes P3, all three contacts are on. By changing the pattern X and the positions of the contacts 13, 24 and 25, various combinations of electrical continuity of the contacts 13, 24 and 25 with reference contact 12 can be achieved.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A multicontact vacuum responsive switch comprising:

a housing;

diaphragm means for dividing the interior of said housing into first and second chambers;

means for connecting said first chamber to a vacuum source;

means for communicating said second chamber with atmospheric pressure, whereby said diaphragm means is movable within said housing in response to a pressure differential between said first and second chambers;

a plate in said housing and movable with said diaphragm means, said plate having an electrically conductive portion;

a plurality of electrical contacts mounted in said housing and slidably contacting said plate such that said contacts may selectively contact said electrically conductive portion of said plate in response to said movement of said diaphragm means; and means for adjusting the position of at least one of said contacts in the direction of movement of said diaphragm means, wherein one of said contacts comprises a reference contact which always contacts said conductive portion and wherein said conductive portion is shaped with a pattern such that each of a remainder of said contacts slidably contact said conductive portion at a predetermined vacuum pressure difference between said first and second chambers.

2. The switch of claim 1 including means for adjusting the position of said diaphragm means.

3. The switch of claim 1 wherein said at least one of said contacts is mounted on a stem slidably mounted to said housing, wherein said contact position adjusting means comprise a first screw threaded to said housing for each said at least one of said contacts and a first spring for biasing each said stem into abutment with one of said first screws.

4. The switch of claim 3 including means for adjusting the position of said diaphragm means.

5. The switch of claim 4 wherein said diaphragm means position adjusting means comprises a second screw threaded to said housing and a second spring having one end pressing on said diaphram means and another end movable with said second screw.

6. The switch of claim 1 wherein said conductive portion has a pattern such that each of said contacts other than said reference contact slidably contacts said conductive portion at a different vacuum pressure level.

* * * * *